US011045812B1

(12) United States Patent
Snaper

(10) Patent No.: US 11,045,812 B1
(45) Date of Patent: Jun. 29, 2021

(54) AUTOGENOUS IMPACT MILL THAT REDUCES SIZE OF FRIABLE MATERIAL

(71) Applicant: Alvin A. Snaper, Las Vegas, NV (US)

(72) Inventor: Alvin A. Snaper, Las Vegas, NV (US)

( * ) Notice: Subject to any disclaimer, the term of this patent is extended or adjusted under 35 U.S.C. 154(b) by 591 days.

(21) Appl. No.: 15/464,776

(22) Filed: Mar. 21, 2017

Related U.S. Application Data

(60) Provisional application No. 62/318,920, filed on Apr. 6, 2016.

(51) Int. Cl.

| | |
|---|---|
| ***B02C 13/08*** | (2006.01) |
| ***B02C 13/09*** | (2006.01) |
| ***B02C 13/28*** | (2006.01) |
| ***B02C 23/16*** | (2006.01) |
| ***B02C 23/26*** | (2006.01) |
| ***B02C 23/24*** | (2006.01) |
| ***B02C 23/28*** | (2006.01) |

(52) U.S. Cl.
CPC ..... *B02C 13/08* (2013.01); *B02C 13/09* (2013.01); *B02C 13/2804* (2013.01); *B02C 23/16* (2013.01); *B02C 23/24* (2013.01); *B02C 23/26* (2013.01); *B02C 23/28* (2013.01); *B02C 2023/165* (2013.01)

(58) Field of Classification Search
CPC ..... B02C 13/08; B02C 13/09; B02C 13/2804; B02C 13/284; B02C 23/26; B02C 23/28; B02C 13/095
USPC ..... 241/56–57, 66; 209/130
See application file for complete search history.

(56) References Cited

U.S. PATENT DOCUMENTS

| | | | | |
|---|---|---|---|---|
| 2,367,179 A * | 1/1945 | Arnold | B02C 13/26 | 241/60 |
| 3,608,840 A * | 9/1971 | Lange | B02C 13/284 | 241/167 |
| 3,887,141 A * | 6/1975 | Francis | B02C 13/09 | 241/52 |
| 3,956,108 A * | 5/1976 | Young | G03G 15/0849 | 209/10 |
| 2007/0034081 A1* | 2/2007 | Kurasek | B03C 3/09 | 96/44 |

FOREIGN PATENT DOCUMENTS

| | | | | |
|---|---|---|---|---|
| GB | 1502154 A * | 2/1978 | B02C 13/04 | |

* cited by examiner

*Primary Examiner* — Kenneth E Peterson
*Assistant Examiner* — Nhat Chieu Q Do
(74) *Attorney, Agent, or Firm* — Ralph E. Jocke; Walker & Jocke

(57) ABSTRACT

An autogenous impact mill (10) is operative to size reduce friable material particles processed through operation of the mill. At least one impeller (58) rotatable within an interior area (44) of a housing (12) of the mill is operative to produce one or more air jets. The air jets are operative to suspend material particles using the Coanda Effect. Other particles moved by the air jets bounce off ricochet bars (74) and impact suspended particles so as to break and reduce the particles to a suitable size to pass through a screen (110) to an outlet opening (42).

27 Claims, 13 Drawing Sheets

AUTOGENOUS IMPACT MILL THAT REDUCES SIZE OF FRIABLE MATERIAL

TECHNICAL FIELD

Exemplary embodiments relate to milling devices that are used to reduce the size of friable material particles. Exemplary embodiments relate to an autogenous impact mill that reduces the size of material particles through impacts with particles suspended in air via the Coanda Effect.

BACKGROUND

Various types of devices are known for processing materials in ways that reduce the size of larger material particles to a desired smaller particle size. Such milling devices are known to act on the material using pulverizing or grinding devices to reduce the size of particles of the material to a desired level. Such known milling devices may require considerable energy input, suffer wear from the required impacts and other forces necessary to pulverize the material particles, and may not produce material particles of a consistent size.

Such prior milling devices may benefit from improvements.

SUMMARY

Exemplary embodiments described herein include an autogenous impact mill that is operative to size reduce friable material particles that are processed through operation of the mill. Exemplary embodiments include a mill having a housing which bounds an interior area. The interior area includes at least one impeller that is rotatable within the interior area. Rotation of the at least one impeller is operative to produce at least one air flow jet within the interior area.

Exemplary embodiments include in cross section a plurality of ricochet bars within the housing on a first lateral side of the at least one impeller. A plurality of fracture plates extend within the housing on an opposed lateral side of the at least one impeller from the side having the ricochet bars. A removable concave lower pan portion extends below the at least one impeller and between the lateral sides of the interior area.

Pieces of the friable material to be processed by the mill are placed in a loading chute. The material pieces pass through an entrance opening into the interior area of the housing. The at least one impeller is operative to engage the material pieces and cause them to be propelled into impacting engagement with the fracture plates to reduce the material pieces to a smaller size. At least one impeller produces at least one air jet within the housing that extends away from the lower concave portion. The at least one jet extends toward the plurality of ricochet bars and an exit opening from the housing. Material particles are suspended by the at least one air jet due to the Coanda Effect. Other material particles are propelled by the at least one jet into the ricochet bars. Particles bounce off ricochet surfaces of the ricochet bars and impact the suspended particles. The impacts between the suspended particles and the particles that ricochet from the ricochet bars breaks the particles into smaller pieces.

In an exemplary arrangement, a screen is positioned adjacent the exit opening from the housing. The screen includes a plurality of screen openings having a screen opening size. Particles that are smaller than the screen opening size are enabled to pass through the screen openings and exit the interior area of the device through a delivery chute. Particles that are too large to pass through the screen openings are prevented by the screen from exiting the interior area and are further processed therein until the size of the particles is sufficiently reduced to enable the particles to leave the interior area through the screen.

DETAILED DESCRIPTION

Figure 1:
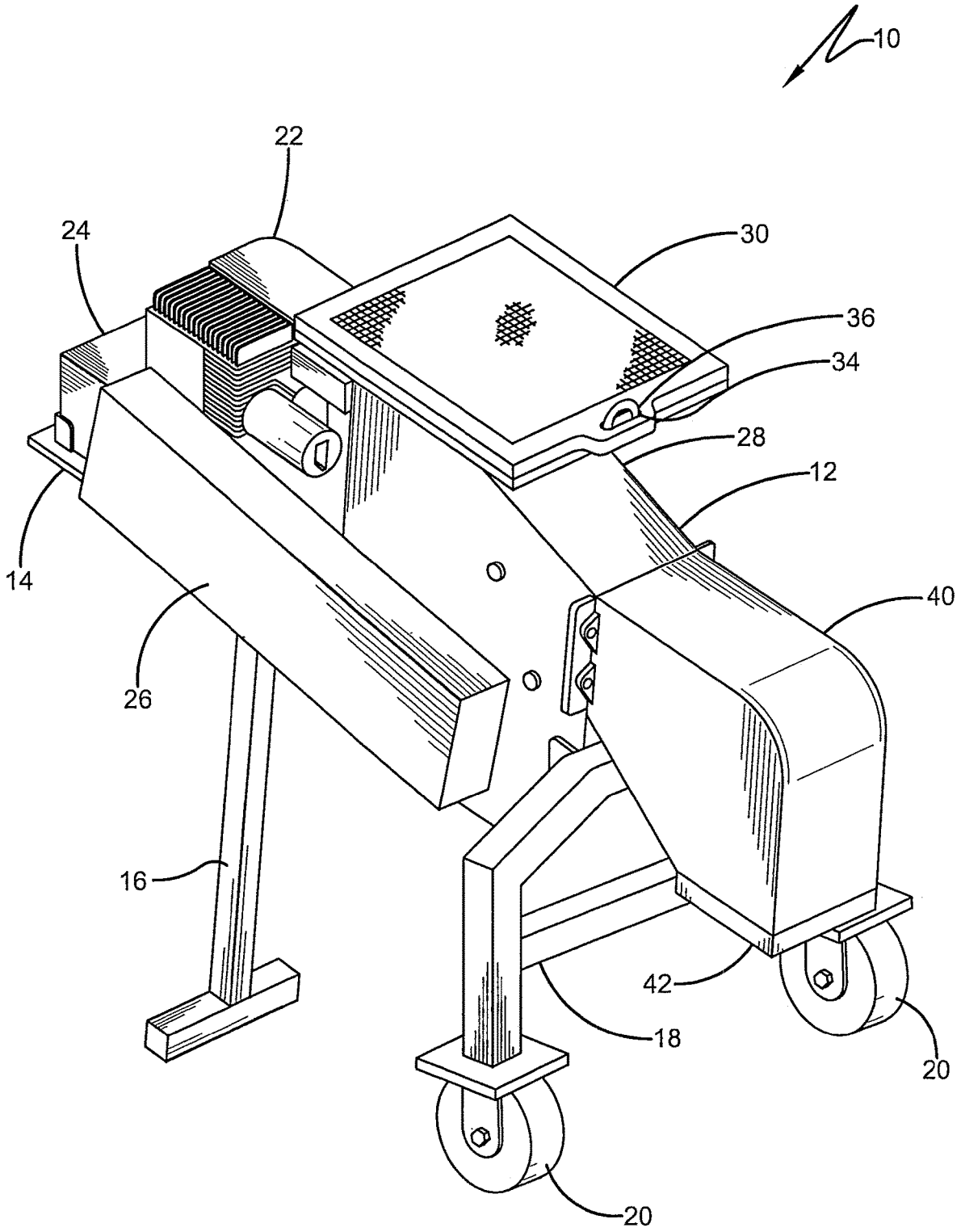
FIG. 1 is a top rear left perspective view of an autogenous impact mill of an exemplary embodiment.

Referring now to the drawings and particularly to FIG. 1, there is shown therein an exemplary embodiment of an autogenous impact mill generally indicated 10. The exemplary mill includes a housing 12. The housing 12 is supported on a frame 14. The exemplary frame 14 includes a front support 16 and a rear support 18. The exemplary rear support includes casters 20 that facilitate the portability of the mill. In the exemplary embodiment, the frame supports a motor 22 such as an internal combustion engine. The exemplary frame 14 further supports other components associated with the mill such as a battery 24. A guard 26 is positioned to overlie a belt, chain or other moving drive members that operatively connect the motor and the powered components within the housing 12. It should be noted that in many of the drawings presented herein, the engine and other components supported by the frame have been omitted to facilitate describing the structure of the mill.

Figure 2:
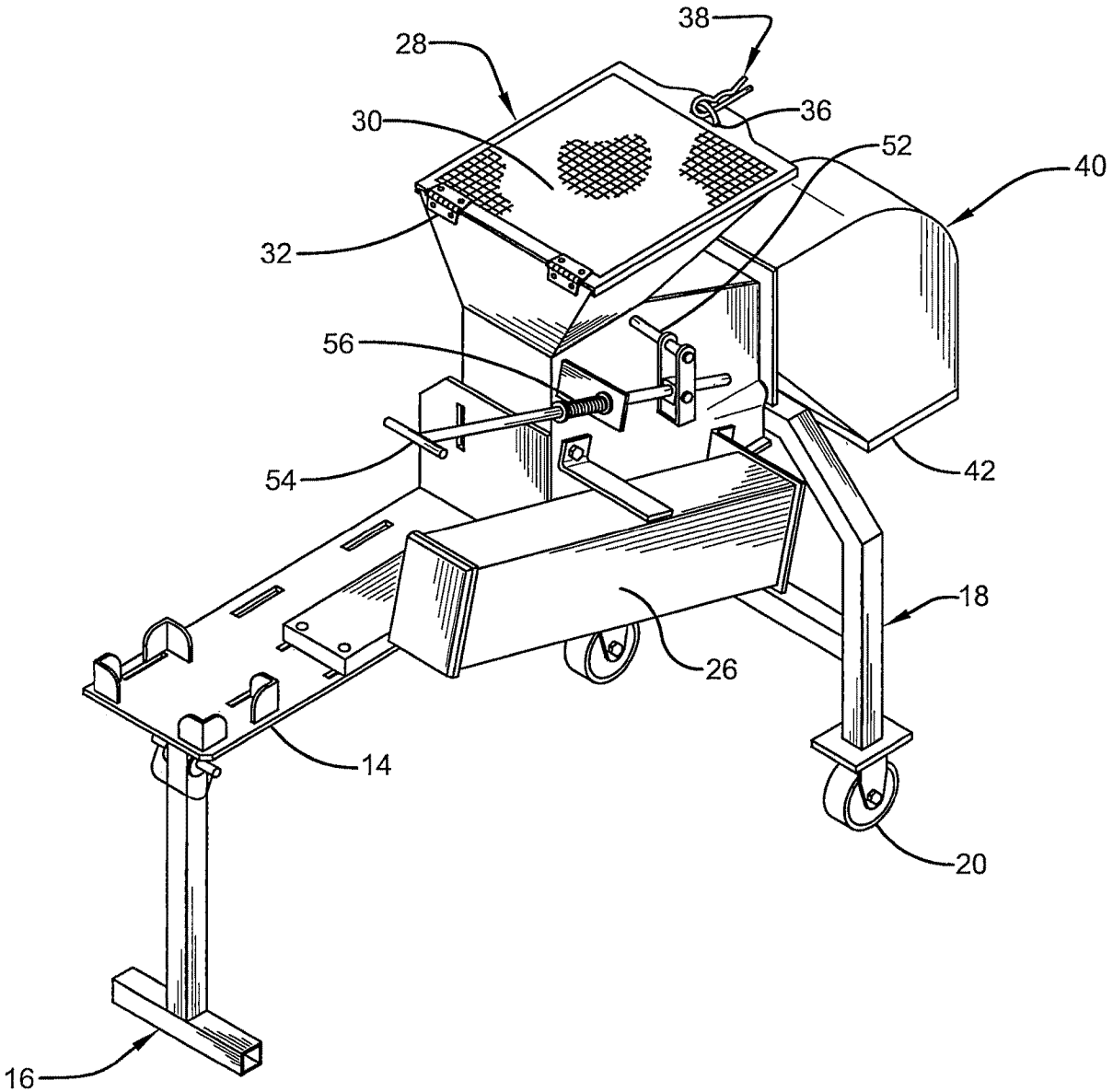
FIG. 2 is a top right perspective view of the impact mill, absent the motor.
Figure 4:
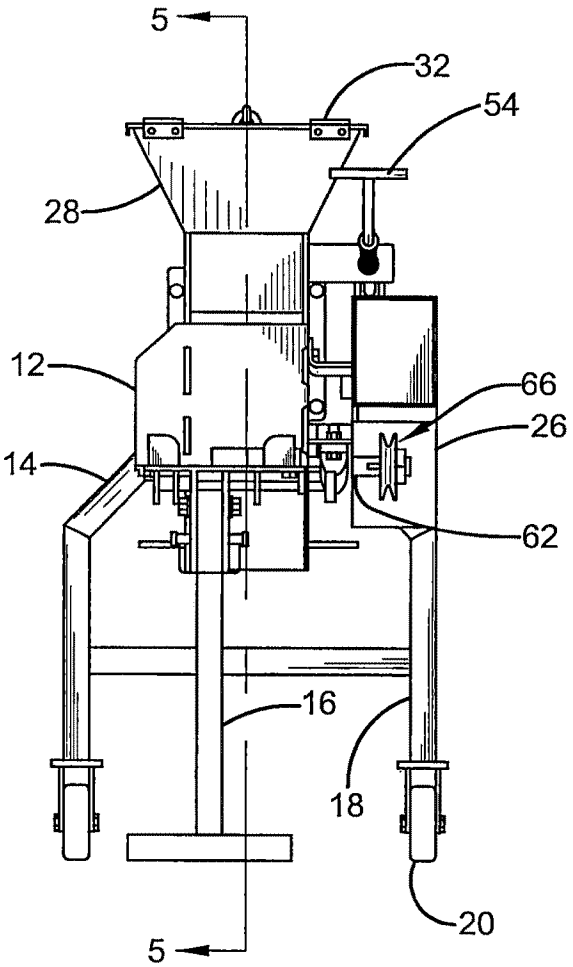
FIG. 4 is a front plan view of the exemplary mill.
Figure 3:
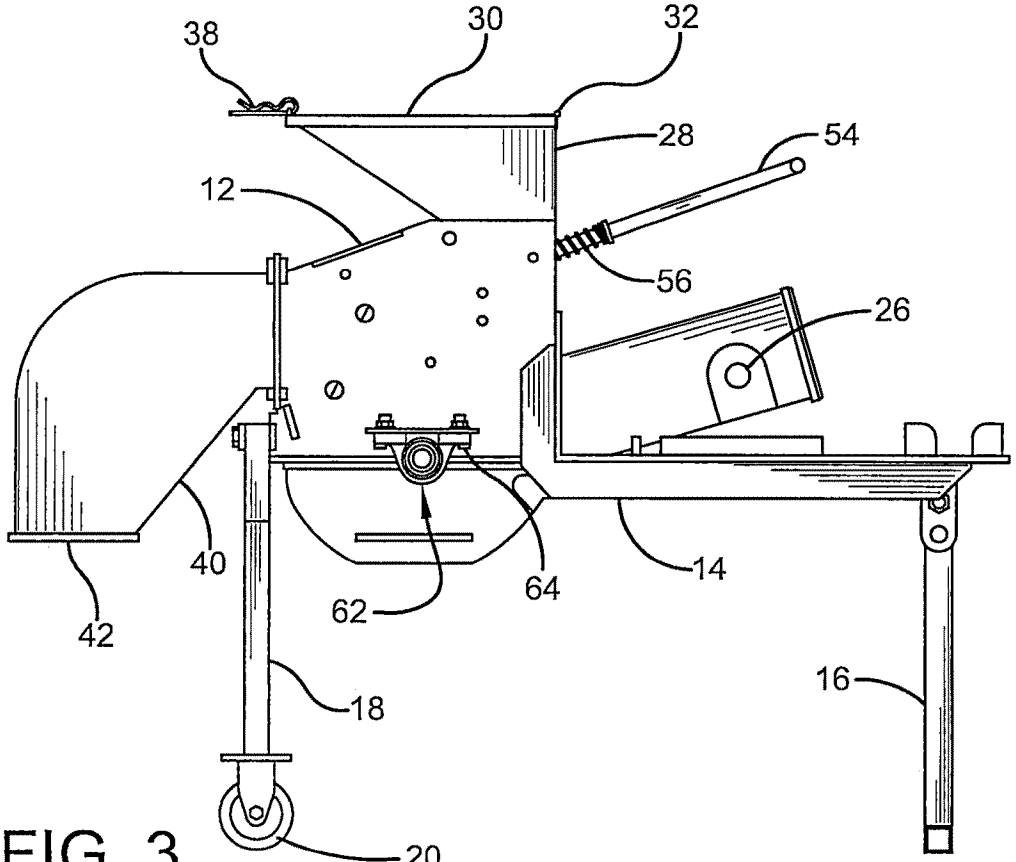
FIG. 3 is a right plan view of the exemplary mill.
Figure 16:
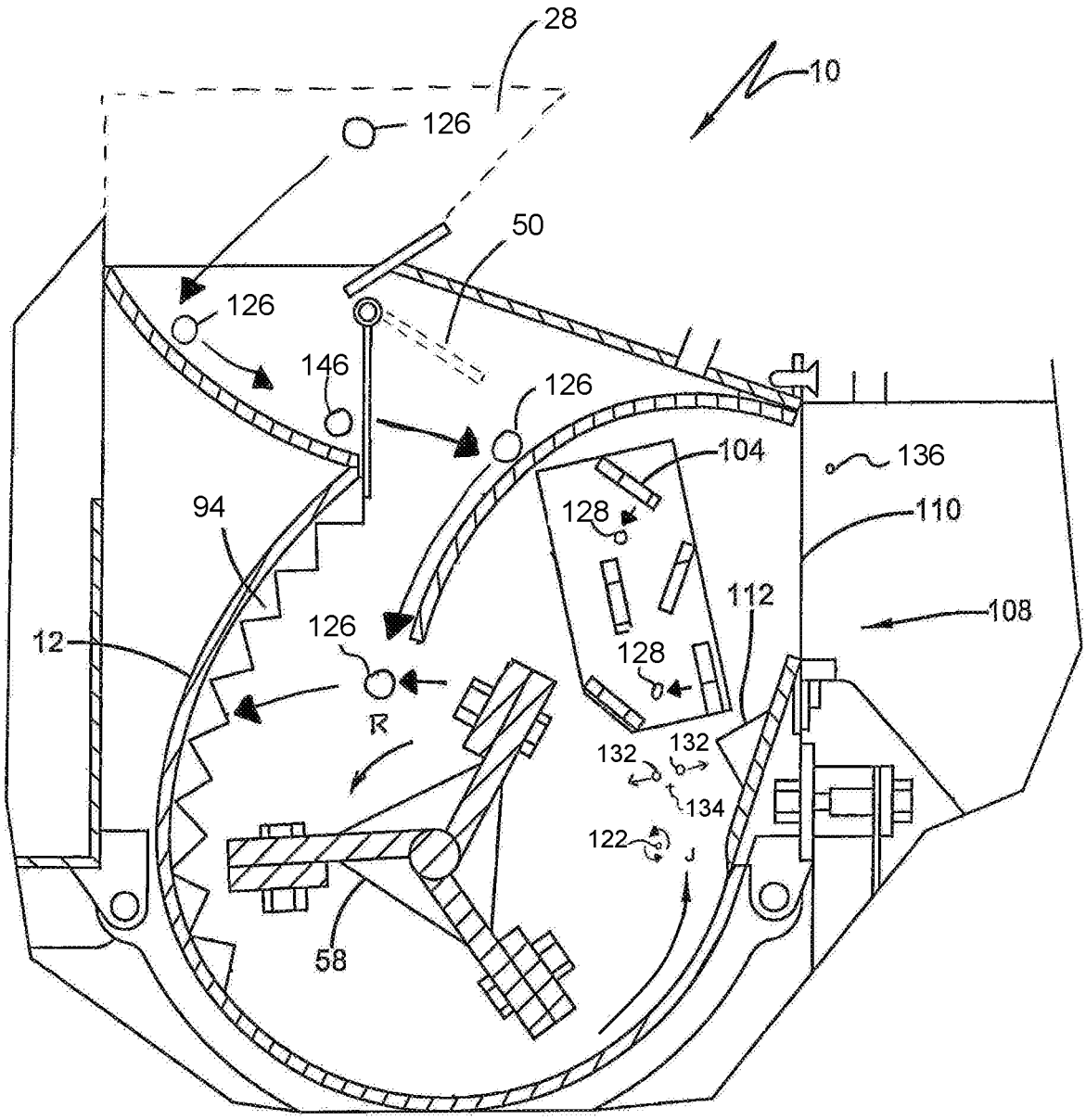
FIG. 16 is a further enlarged view of the interior area of the housing including a representation of material particle positions, collisions, and movements in the housing interior area.

The exemplary embodiment of the mill further includes a loading chute 28. The exemplary loading chute 28 is used to receive pieces of friable material that are to be processed and reduced in size through operation of the mill, represented by material pieces 126 in loading chute 28 as shown in FIG. 16. The exemplary loading chute includes a top opening that can be selectively covered by a hinged screen 30. The screen enables air flow therethrough. The hinged screen 30 is movably mounted on hinges 32 as shown in FIG. 2. The hinged screen 30 further includes an opening 34 through which a loop or other fastening member 36 may extend when the screen is in a closed position. As shown in FIG. 2, the exemplary loop is sized for accepting a removable pin 38 or other suitable fastening device for holding the screen 30 in a closed position. As can be appreciated in the exemplary embodiment, the hinged screen can be closed and secured by the pin 38 when the mill 10 is operating to avoid the risk of material flying out of the top of the loading chute 28.

The exemplary embodiment further includes a delivery chute 40. The exemplary delivery chute 40 includes a downward directed outlet opening 42. The outlet opening is configured to pass particles of material that have been processed by the mill out of the delivery chute and into a suitable holding bin or other suitable receptacle for receiving the processed material particles.

Figure 5:
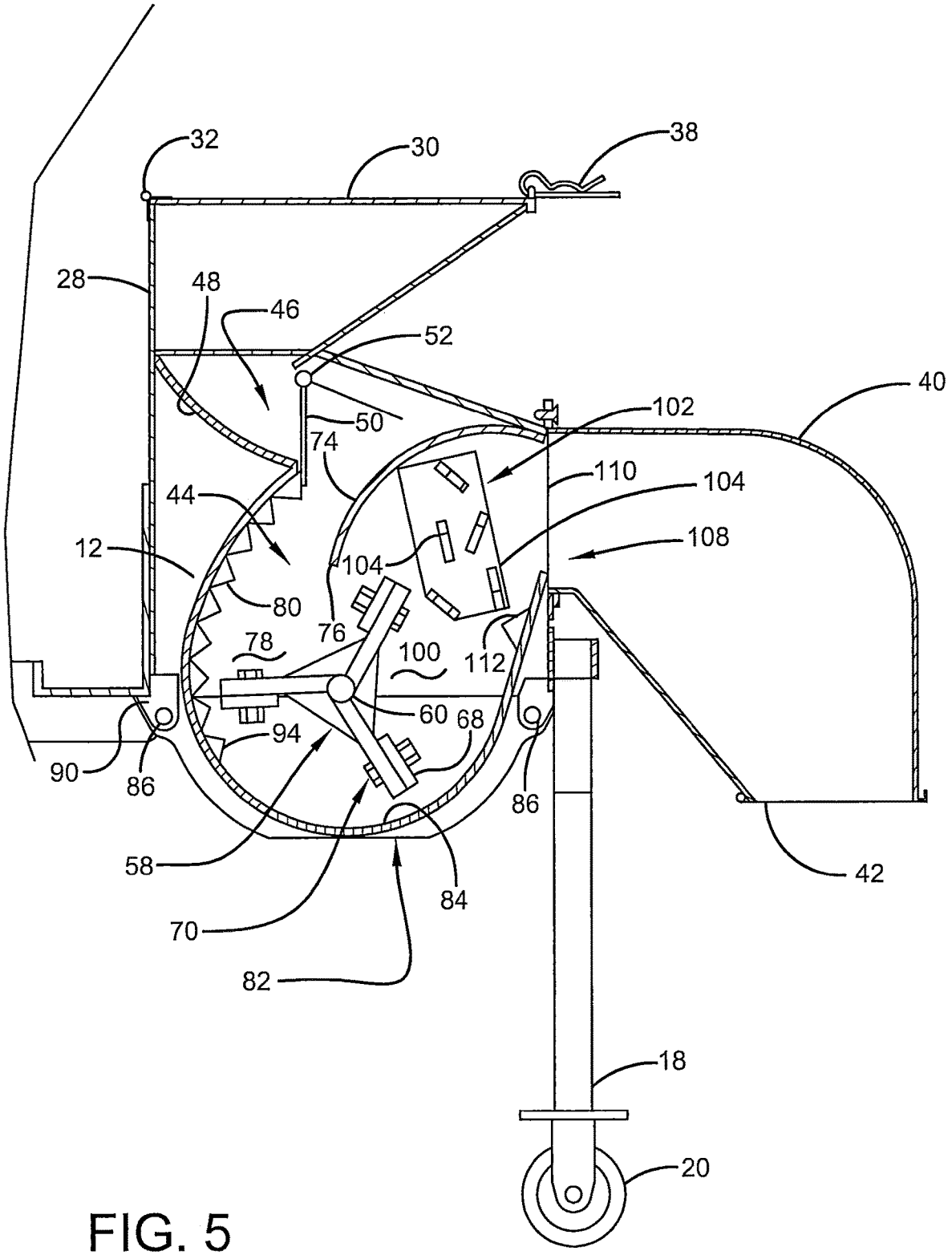
FIG. 5 is an enlarged cross-sectional view taken along line 5-5 in FIG. 4 showing the interior area of the housing.
Figure 6:
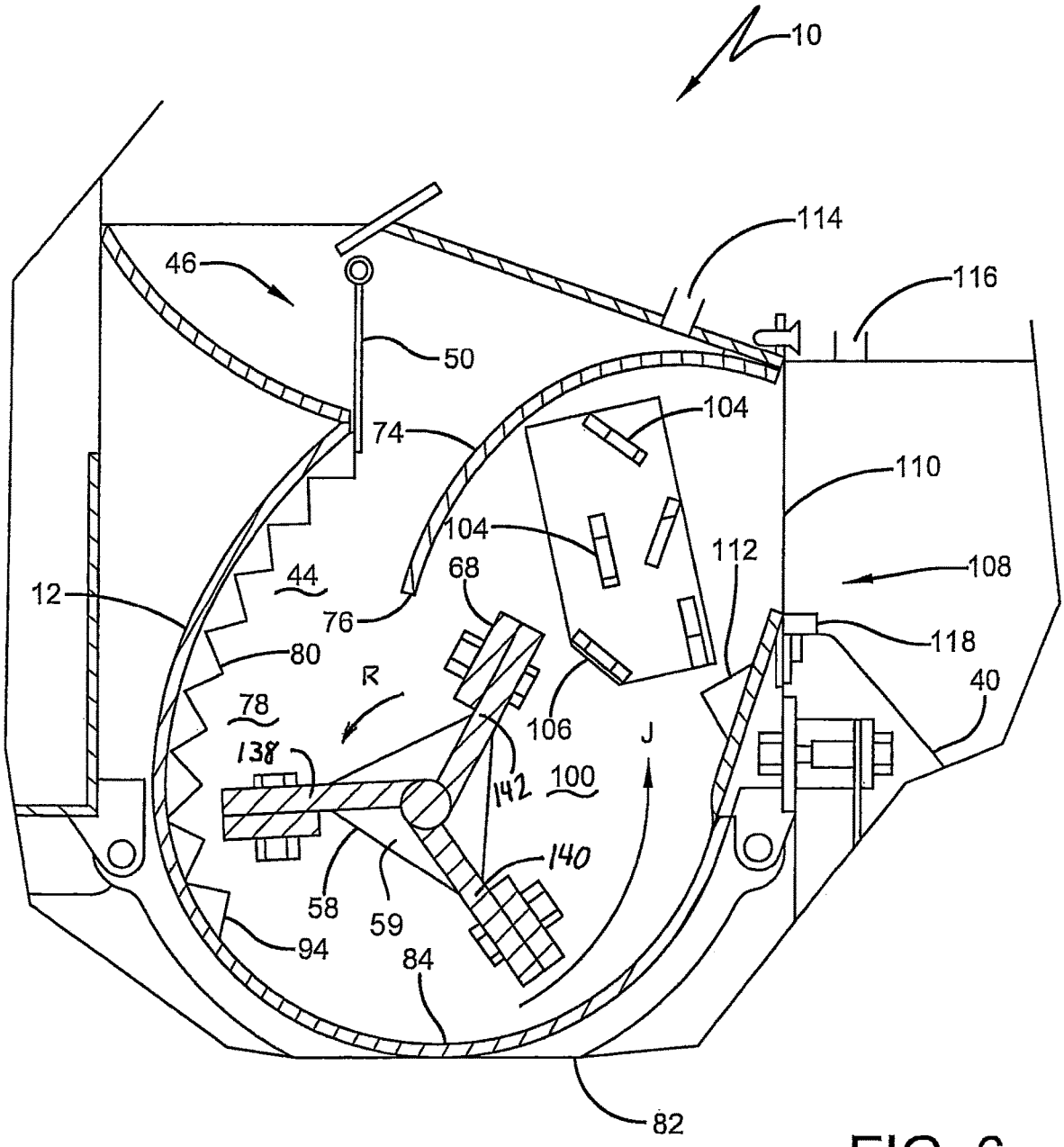
FIG. 6 is a further enlarged view of the interior area of the housing including a representation of the action of the at least one impeller to produce at least one air jet.

As shown in vertical cross section in FIGS. 5 and 6, the housing 12 includes an interior area 44. An entrance opening 46 to the interior area extends below the loading chute 28. A guide plate 48 includes a concave surface that directs material pieces in the loading chute toward the entrance opening.

In the exemplary embodiment, a valve plate 50 is selectively movable in the entrance opening. The valve plate 50 is movable between a closed position which is shown in solid lines in FIGS. 5 and 16 and an open position which is shown in FIG. 5 in phantom. In the exemplary arrangement, the exemplary valve plate is rotatable on a pivot shaft 52 responsive to manual actuation of a lever 54. In the exemplary embodiment, a spring 56 biases the lever outward such that the valve plate 50 is rotationally biased toward the closed position. Manually moving the lever 54 against the biasing force of the spring 56 operates to cause the pivot shaft 52 to rotate the valve plate 50 toward the open position. As can be appreciated, the movement of the lever 54 enables controlling the delivery of material pieces 126 from the loading chute into the interior area of the housing. This enables the operator of the exemplary mill to avoid overloading the mill so that it is not bogged down with excess material entering the interior area of the housing. As shown in FIG. 16, material pieces 146 near the entrance opening 46 are stopped from entering the housing interior area when the valve plate 50 is in the closed position. Of course it should be understood that this approach is exemplary and in other embodiments, other approaches may be used.

In the exemplary embodiment, at least one impeller 58 is rotatably mounted in the interior area. In the exemplary embodiment, the impeller 58 is rotatable with a shaft 60. The shaft 60 is supported on bearings 62 which are attached to the housing 12 through suitable fasteners 64. The impeller shaft 60 is driven by the motor 22 rotationally driving a suitable pulley 66 or other suitable rotating member that is attached to the shaft 60. In other embodiments multiple impellers that rotate on one or more shafts may be utilized.

Figure 7:
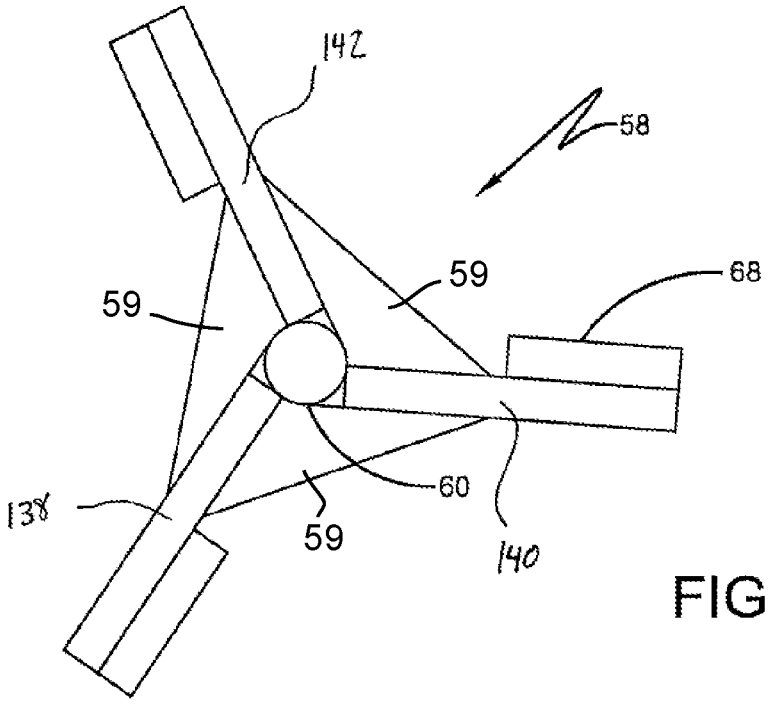
FIG. 7 is a side view of an exemplary impeller without the impeller head fasteners.
Figure 8:
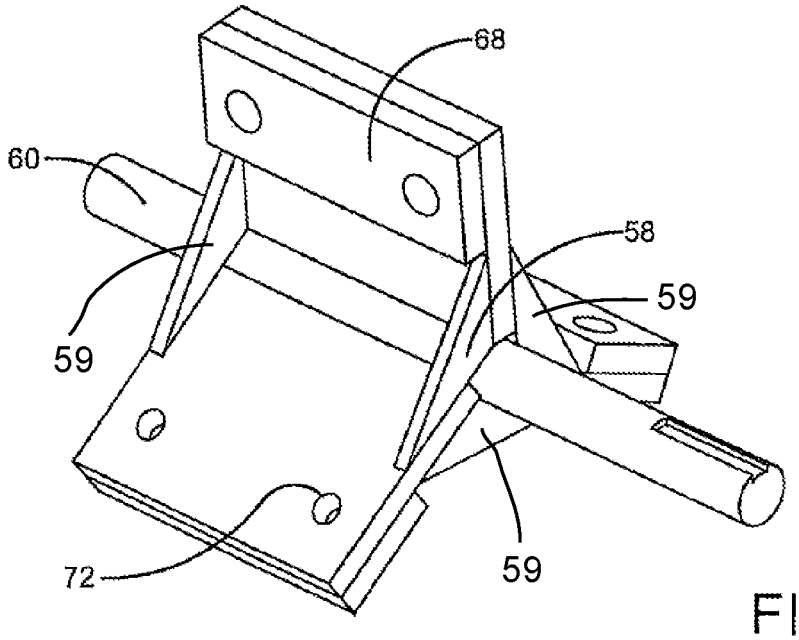
FIG. 8 is a perspective view of the exemplary impeller of FIG. 7.
Figure 15:
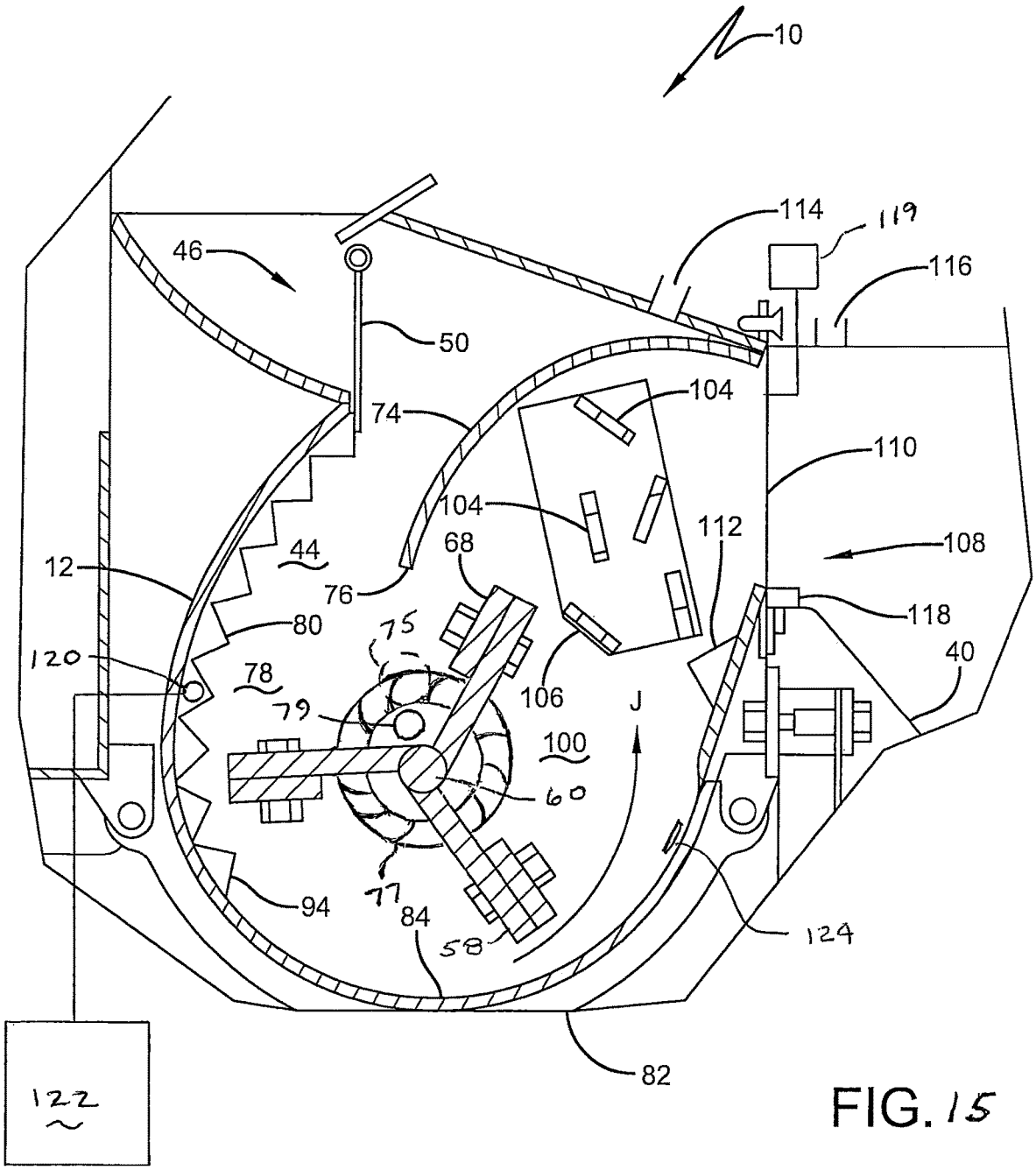
FIG. 15 is an enlarged view of the interior area of an alternative embodiment.

In an exemplary embodiment, the rotatable impeller 58 includes a plurality of angularly disposed outer peripheral heads 68. In some exemplary embodiments the impeller heads may include generally flat continuous planar leading faces that extend generally horizontally across the majority of the interior area of the housing. In other embodiments the impeller heads may have a contoured configuration. Such contours may have curved surfaces that tend to direct impacting particles toward the transverse central area of the housing interior. As shown in FIGS. 6 and 7, the exemplary impeller heads 68 are attached to radially extending arms 138, 140, and 142 of the impeller through suitable fasteners 70. The fasteners 70 extend through suitable openings 72 which extend through the impeller heads and arms to hold the components in engagement. In some exemplary embodiments, as shown in FIGS. 6-8, the exemplary arms 138, 140, and 142 may extend radially outward beyond the shaft 60 a distance greater than three times the diameter of the shaft 60. Additionally, in some exemplary embodiments, the exemplary arms 138, 140, and 142 may be further supported by support braces 59. As shown in FIGS. 6-8, the exemplary support braces 59 extend angularly intermediate of and in fixed operative engagement with each of the angularly adjacent pair of arms, and are disposed entirely radially inwardly of the respective outer peripheral impact heads 68. Of course it should be understood that this arrangement is exemplary and in other embodiments, other arrangements may be used. For example in other exemplary embodiments, the impeller heads may include contours that cause greater air movement. This may include causing greater air flow in a counterclockwise direction as shown within the interior of the housing in the direction of movement of the radially outward ends of the impeller heads. Further in some exemplary arrangements, the impeller may additionally include in operative connection therewith, fan blades that enhance desired air flow properties, such as suitable speeds and directional flows within the housing. For example in some arrangements such as is shown in FIG. 15 fan blades 77 may rotate with the shaft 60. The fan blades may be configured to direct air flow in the circular direction of rotation of the impeller heads 68. The airflow may also be directed toward the horizontally transverse middle area of the housing 12 so as to reduce the collection of material on the transverse sides of the housing. In some exemplary arrangements a manifold 79 extending coaxially with or otherwise adjacent to the shaft may be used to draw air from outside of the housing into selected areas of the housing interior in proximity to the fan blades and/or the impeller heads. For example air may be delivered from outside the housing into an area radially within the arc of rotation of the fan blades and/or impeller heads to achieve circumferential and radial acceleration of such incoming air by the fan blades and/or impeller heads to create higher volumes and speeds of air flows within the housing. Further in some arrangements the rate of outside air flow into the housing interior from the outside may be controlled by an external flap valve 75 or similar structure to tailor the air flow to the properties and amount of material processed by the mill. Of course numerous different approaches may be used.

The interior area 44 of the housing 12 further includes a guide plate 74. The guide plate 74 includes a convex surface that extends below the entrance opening 46. The guide plate terminates at an inward end 76. The inward end 76 is positioned such that the impeller heads 68 pass in close proximity thereto as the impeller rotates within the housing. In the exemplary embodiment, the impeller rotates in a counterclockwise direction as shown during operation as represented by Arrow R in FIG. 6. Opening the valve plate 50 moves the valve plate initially closer to and then further away from the guide plate 74.

In the exemplary embodiment the interior area on a first lateral side of the impeller generally indicated 78 is bounded by a plurality of fracture plates 80. In the exemplary embodiment the fracture plates are arranged at convergent angles and terminate in a plurality of disposed inwardly pointed apexes in cross section. As later explained, the fracture plates are configured to be impacted by pieces of friable material that are propelled by engagement with the heads of the impeller toward the apexes and fracture plates to facilitate the breaking up of such material pieces. Of course it should be understood that the exemplary arrangement of fracture plates 80 is but one of numerous arrangements that may be used for this purpose.

Figure 12:
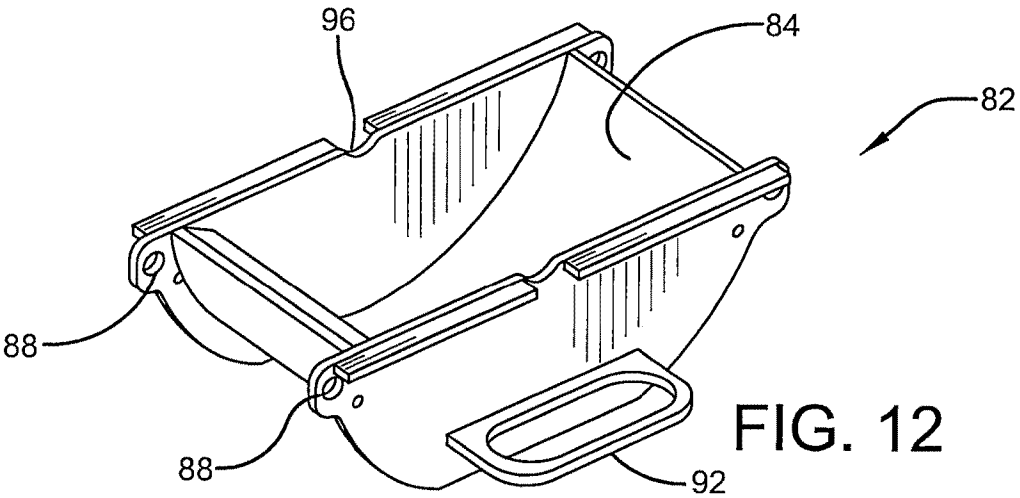
FIG. 12 is a perspective view of the exemplary removable concave lower pan portion of the housing.
Figure 13:
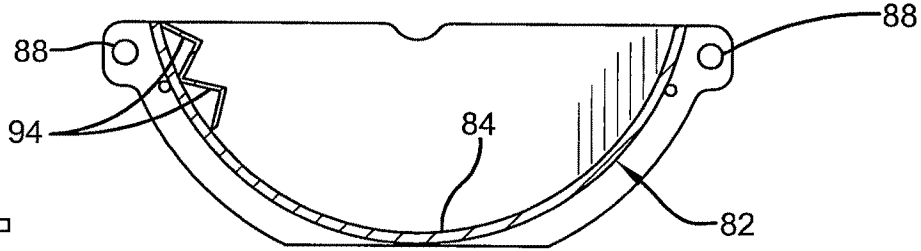
FIG. 13 is a cross-sectional view of the lower pan portion.
Figure 14:
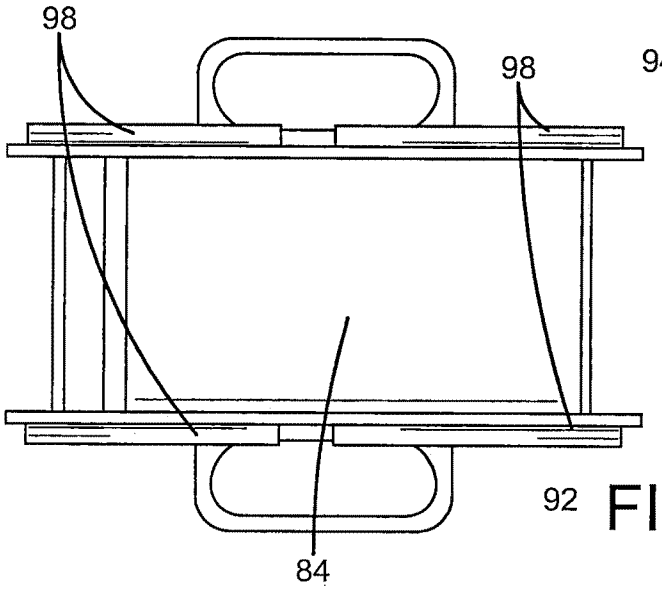
FIG. 14 is a top view of the exemplary lower pan portion.

The exemplary housing 12 includes a removable concave lower pan portion 82. Lower pan portion 82 is bounded inwardly by a concave surface 84 that extends below the impeller 58. The exemplary embodiment of the lower pan portion 82 which is shown in greater detail in FIGS. 12-14 is releasibly connected to the housing 12 through pins 86. Pins 86 removably extend through openings 88 in the pan portion and ears 90 on the housing. In exemplary arrangements, suitable clips are utilized for holding the pins 86 in engagement with the pan portion and the housing during operation. For example in some exemplary arrangements the fracture plates may be configured so that the apexes extend generally horizontally across generally the entire interior area of the housing. In other arrangements the fracture plates may include offset apex structures or other structures such as pyramids, spikes or other configurations that will fracture the material particles on impact and then enable the fractured particles to disengage from the structures against which they are impacted.

As shown in FIGS. 12-14, the exemplary lower pan portion includes a pair of opposed handles 92. Handles 92 facilitate removal and installation of the lower pan portion. The exemplary lower pan portion further includes fracture plates 94 which serve the same function as fracture plates 80 higher up on side 78 of the interior area. The fracture plates 94 have a similar configuration as fracture plates 80 and are attached to the concave surface 84. In the exemplary embodiment, the removable concave lower pan portion includes recesses 96 through which the shaft 60 extends. The sides of the pan portion further include flanges 98 which are configured to be in generally abutting relation with corresponding lower surfaces of the housing. The flanges enable the removable concave lower pan portion to be in generally tight engagement with the housing when the pan portion is mounted thereto so as to prevent the escape of material from between the housing and the pan.

Figure 9:
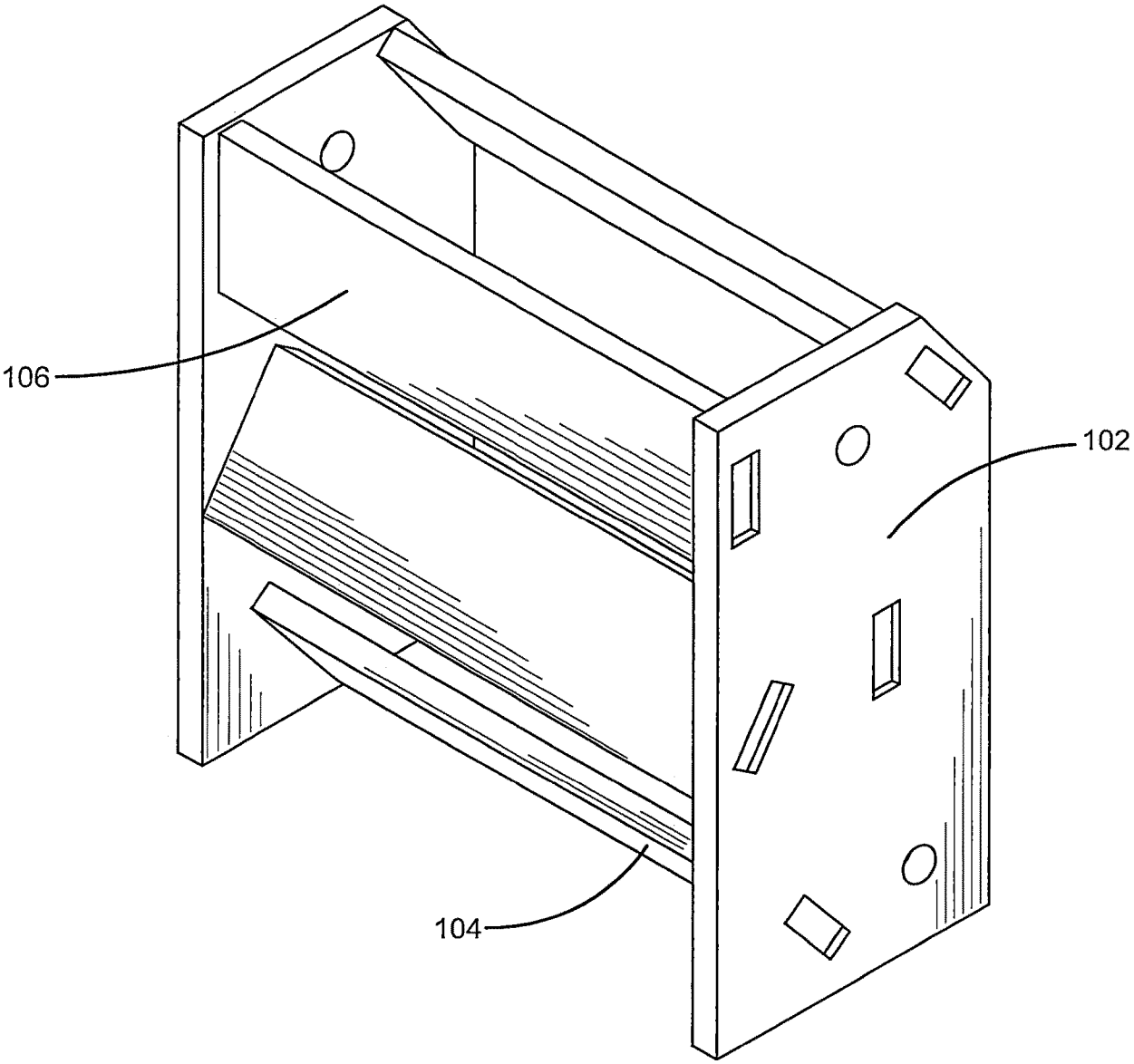
FIG. 9 is a perspective view of an exemplary assembly of ricochet bars.
Figure 11:
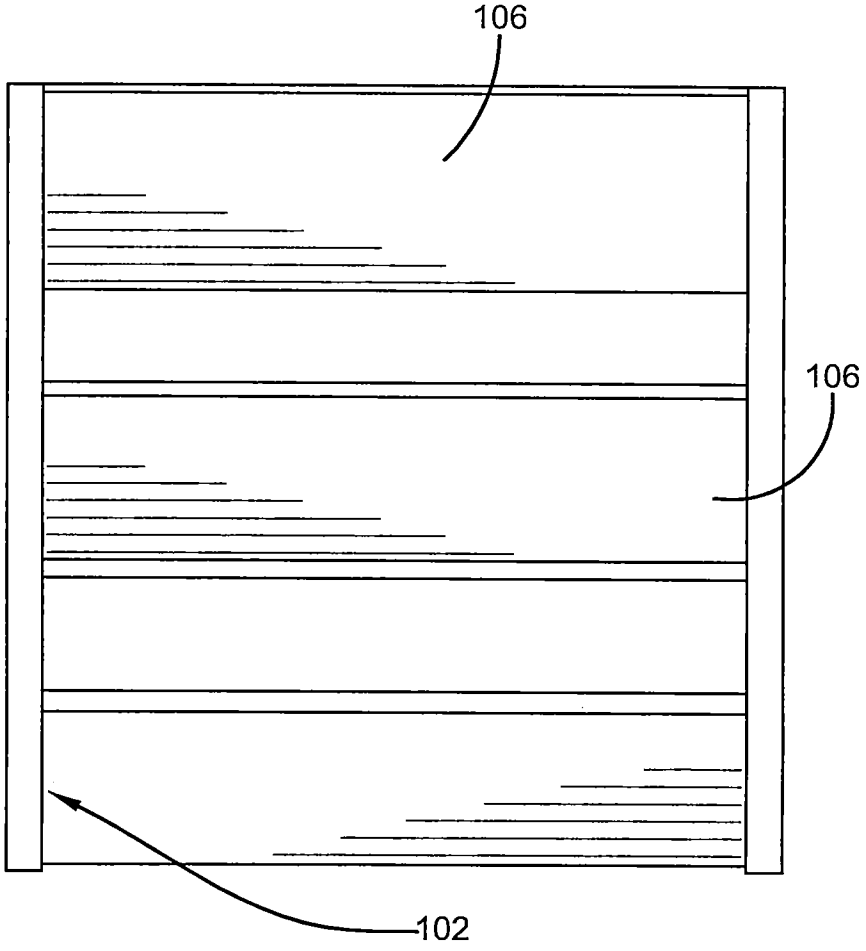
FIG. 11 is a front view of the exemplary ricochet bars.
Figure 10:
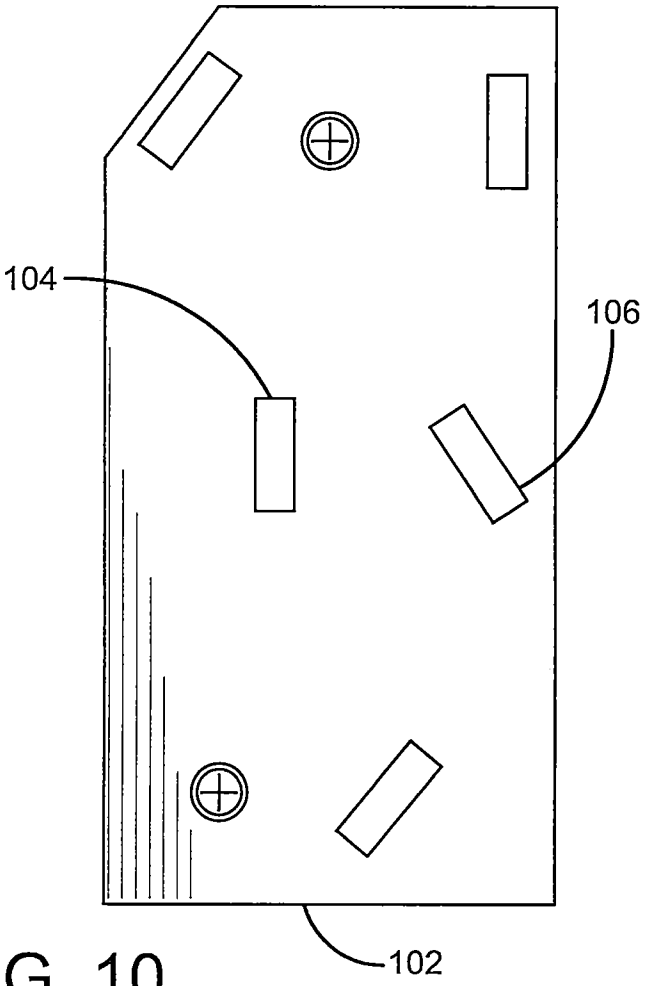
FIG. 10 is a side view of the exemplary ricochet bars.

The interior area 44 of the housing 12 further includes a second lateral side generally indicated 100 that in vertical cross section of the housing is on the opposed side of the impeller 58 from the first side 78. A housing 102 is mounted on the second side 100. Housing 102 includes a plurality of ricochet bars 104. As shown in greater detail in FIGS. 9-11, the exemplary ricochet bars 104 each include a ricochet surface 106. The exemplary ricochet surfaces extend at a plurality of different angles. The different angles of the ricochet surfaces on the ricochet bars are configured to cause particles of material that impact the ricochet bars to bounce off of them at a plurality of different angles and in numerous directions as represented by material particles 128 shown in FIG. 16. This helps to facilitate the breaking of the material particles by the mill in a manner that is later explained.

The interior area 44 of the housing further includes an exit opening 108. Exit opening 108 is in connection with the interior of delivery chute 40. In the exemplary arrangement a screen 110 extends between the ricochet bars and the exit opening 108. The exemplary screen 110 includes a plurality of screen openings. The screen openings have a uniform screen opening size that corresponds to the maximum size of the material particles that the mill is configured to produce. Thus in the exemplary arrangement, material particles that have been broken and are below the size of the screen openings are enabled to pass out of the interior area 44 through the screen 110, as represented by material particles 136 as shown in FIG. 16, and into the delivery chute 40 from which they are delivered through the outlet opening 42.

In the exemplary embodiment a ramp surface 112 extends in cross section inwardly and downward into the area 100 below the screen 110. Ramp surface 112 is configured to direct material particles that are collected on the screen because they are too large to pass therethrough, to fall downwardly into the interior area 100 below the housing 102 which includes the ricochet bars.

As represented in FIG. 6, in operation of an exemplary embodiment, the impeller 58 rotates in a counterclockwise direction as shown represented by arrow R within the interior area 44 of the housing 12. The internal configuration of the housing including the concave surface 84 of the lower pan portion 82 is operative to cause at least one air jet labeled J in FIG. 6 to be produced within the area 100 shown on the right side of the impeller. Material pieces that enter the interior area through the entrance opening 46 and which move past the valve plate 50 in the open position engage the upper convex surface of the guide plate 74 as represented by material pieces 126 in engagement with guide plate 74 in FIG. 16. The material pieces 2 move downwardly in engagement with the guide plate. Upon reaching the inward end 76 of the guide plate the material pieces 126 are impacted and propelled by engagement with the impeller heads 68 to the left as shown in FIGS. 6 and 16. The impact of the material with the heads fractures the material into smaller pieces. Material pieces 126 are propelled by the impeller heads to impact against the fracture plates 80, 94 which extend on the side 78 of the impeller, as shown in FIG. 16. The engagement of the material pieces with the impeller heads and the fracture plates operates to fracture the incoming material pieces into smaller particles.

Figure 17:
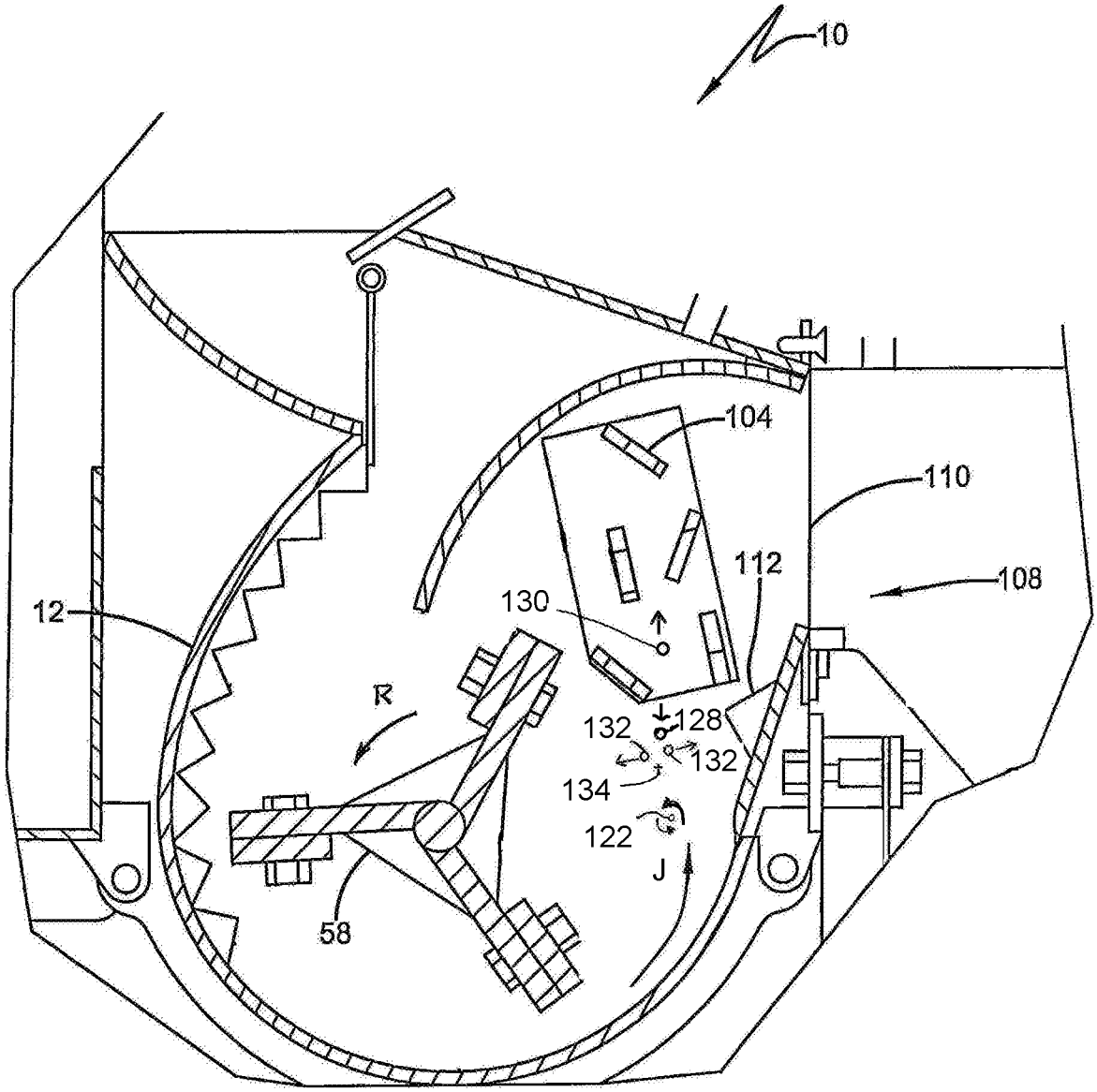
FIG. 17 is a further enlarged view of the interior area of the housing including a representation of material particle positions, collisions, and movements in the housing interior area.

In an exemplary arrangement, the particles 130 that have been reduced in size by engagement with the fracture plates, are moved with the air flow generated by the impeller to the lateral side 100 of the interior area opposite side 78. Particles of material in the vicinity of the at least one air jet are suspended by the jet as represented by material particles 122 as shown in FIG. 17. The Coanda Effect is operative to cause the moving air of the jet to follow the convex surfaces of the particles 122 which causes such particles to be suspended by the one or more air jets as they extend away from the concave surface 84. In the exemplary embodiments, the particles 122 are suspended by the Coanda Effect in the area above the one or more air jets. However, in other embodiments, material particles may be suspended on a lower side of the air jet or on both sides of one or more air jets.

In exemplary arrangements, particles that are not suspended by the Coanda Effect are carried by the air jets toward the exit opening 108 from the housing. The material particles that are moved by the air jets are propelled into the ricochet bars 104 and fracture and/or bounce off the ricochet surfaces 106 at the various angles of the plurality of ricochet bars.

In the exemplary embodiment the particles that bounce off the ricochet surfaces (as represented by ricochet particles 128 in FIG. 17), ricochet into engagement with the particles 122 that have been suspended by the one or more air jets in area 100 of the housing. The impacts, represented schematically by mark 134 between the ricochet particles 124 and the suspended particles 122 are operative to cause the particles to be broken and to produce particles 132 that are reduced in size from the previous particles. This action of repeated impacts between ricochet particles and suspended particles are operative to repeatedly reduce the size of the particles within the housing.

In operation of the exemplary embodiment, at least a portion of the particles on a second side 100 of the housing are moved by the air flow within the housing interior area and the impeller back to side 78 of the interior area. Such particles may impact with additional incoming material pieces and the fracture plates 80, 94 so as to be further reduced in size as well. Such particles may be again carried by the air flow jets along the concave surface 84 and into side 100 of the interior area.

Particles 136 that have been sufficiently reduced in size below the size of the screen openings in screen 110 may flow between the ricochet bars and pass through the screen. Such particles exit the mill through the delivery chute 40. Material particles that are too large to pass through the screen 110 fall downwardly on the screen and are directed by ramp surface 112 back into second side 100 of the interior area where they may be suspended or otherwise moved so as to undergo further impacts which reduce the particle size until such particles can be passed out of the housing through the screen 110.

Further in exemplary embodiments, other or additional fluidic pressure devices may be utilized that facilitate the processing operation of the mill 10. For example in some exemplary embodiments, a positive pressure port 114 as shown in FIG. 6 may be positioned above the convex upper surface of guide plate 74. Positive pressure port 114 may be in operative connection with a source of positive air pressure. Such positive air pressure may be applied into the interior area so as to urge the movement of material pieces along the convex surface of the guide plate 74 toward the inward end 76. Such positive pressure applied to the port 114 in exemplary embodiments may further reduce the amount of dust or other particulate material that may move through the entrance opening 46 and out of the screen covering the loading chute. This will reduce the amount of dust that is in the area where the mill 10 is operated.

Further in exemplary embodiments a negative pressure port 116 may be positioned to draw air out of the interior area 44. In exemplary embodiments the negative pressure port 116 may be in operative connection with a negative pressure device such as a vacuum system and/or dust collector. The vacuum system and negative pressure port 116 may operate to draw air out of the interior area 44 of the housing. In exemplary arrangements, the negative pressure port may further facilitate the flow of air from the interior area through the exit opening 108 and the screen 110. This negative pressure port may further facilitate the rate at which material particles that have been sufficiently reduced in size are drawn out of the interior area 44 and through the delivery chute. This increases the processing speed of the mill.

Further in exemplary arrangements one or more vibrators 118 such as for example pneumatically actuated vibrators, may be in operative connection with the screen 110 to facilitate the shedding of particles which cannot pass through the screen such that they drop off the screen and are directed by the ramp surface 112 back into the interior area of the housing. However, it should be appreciated that in some arrangements the turbulence in the air flow generated within the housing or the normal vibration of the mill during its operation are sufficient to cause the surface of the screen 110 that faces the interior area to shed particles that are too large to pass therethrough.

Further it should be understood that the arrangement of positive and negative pressure ports and other features described herein are exemplary. Other or additional pressure ports, devices or arrangements may be included in exemplary embodiments to facilitate the operation of milling apparatus that include the principles described herein. Numerous exemplary arrangements may include fluidic elements that facilitate the desired air flow which accomplishes the desirable suspension of friable material particles and impacts which in exemplary embodiments achieve the reduction in particle sizes. Numerous different fluidic elements may be implemented in components utilized in example arrangements which enable the control of vacuum and pressure without moving parts. Examples of capability to control vacuum and pressure through fluidic elements are demonstrated in patents that are owned by the applicant hereof, such as for example, U.S. Pat. Nos. 3,574,460; 3,628,601; 4,407,134; 4,435,719; and 4,570,597, the disclosures of which are incorporated herein by reference in their entirety.

Figure 18:
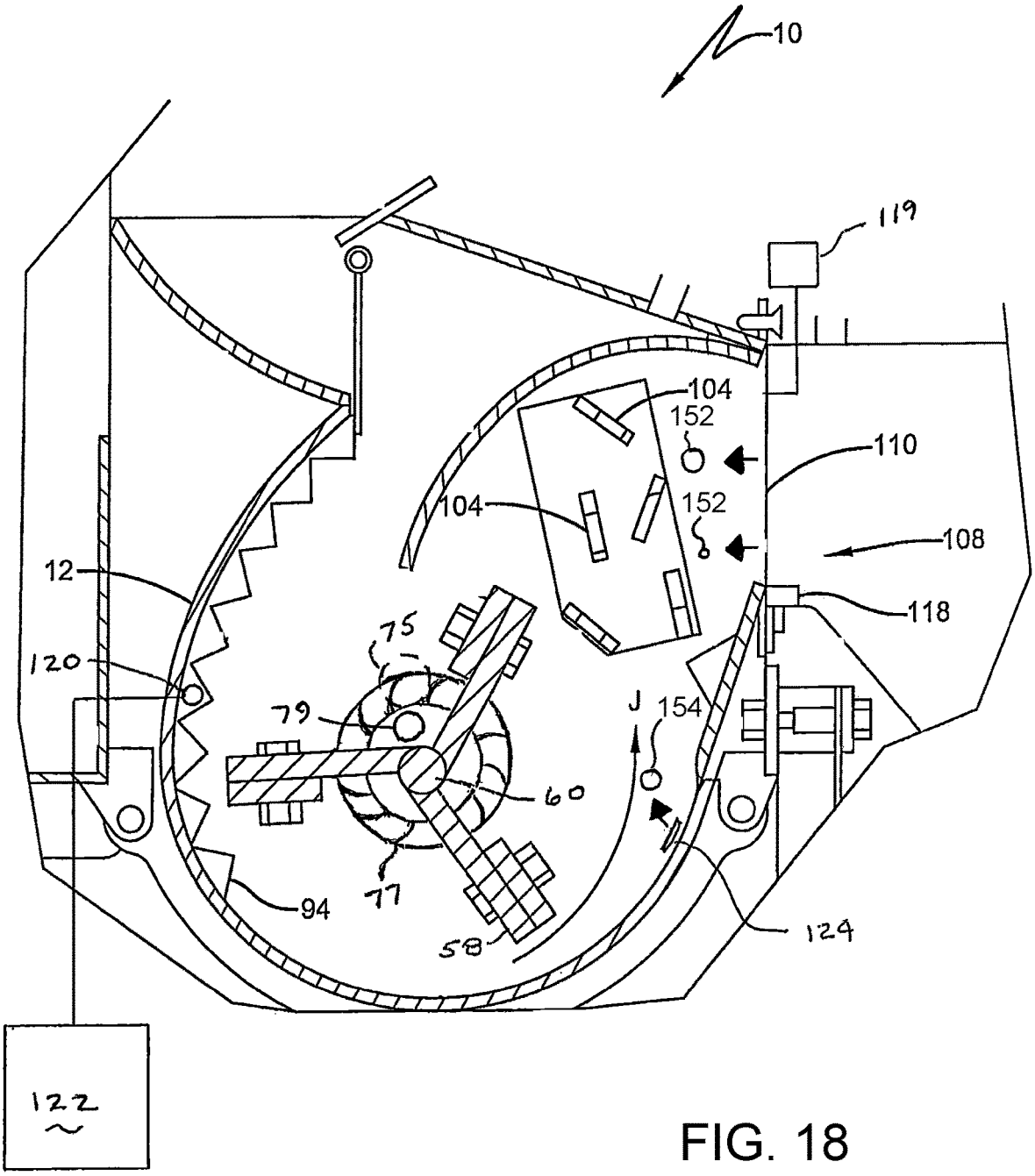
FIG. 18 is an enlarged view of the interior area of an alternative embodiment including a representation of material particle positions, collisions, movements, and repulsions in the housing interior area.

In other exemplary embodiments other components and features may be utilized to facilitate operation of the mill. For example, in some exemplary arrangements electrostatic charge may be applied to facilitate the suspension of particles and to assure effective flow of material from the exit opening of the housing. In some exemplary arrangements the exit screen 110 may tend to collect particles even in the presence of mechanical devices that help to separate particles from the screen. As represented in FIGS. 15 and 18, in such arrangements circuitry 119 may operate to cause the screen to be charged with an electrical charge that reverses on a periodic basis. In this manner particles that cling to the screen may take on a charge opposite to that of the screen. Such particles may be repelled from the screen and be returned to the interior area of the housing when the circuitry operates to reverse the charge on the screen as represented by material particles 152 as shown in FIG. 18.

In other arrangements electrostatic charge may be used to help suspend particles in the area of the housing where such particles are most likely to be subject to being impacted by particles moving after impact with the ricochet bars. For example, in some arrangements as represented in FIGS. 15 and 18 the fracture plates may include electrodes 120 connected to circuitry 122 which causes the particles that impact against the fracture plates to have a common charge. Such charge may serve to help to keep the particles disbursed from each other as they are suspended by the Coanda Effect in the area where they sustain impacts with other particles. Further in other exemplary arrangements, as shown in FIG. 18, charged electrodes 124 may be positioned in the housing to maintain such particles 154 in suspension away from the walls of the housing. Such electrodes 124 may be charged to repel the particles 154 so that such particles have a longer residence time within the region in which the particles are most likely to be subject to impacts with particles travelling away from the ricochet bars as represented in FIG. 18. Of course the ability to utilize electrostatic effects to control the suspension of particles will vary with the properties of the material to be processed through operation of the mill.

Although arrangements have been described based on certain exemplary embodiments, a wide array of modifications, variations and alternative constructions are also within the spirit and scope of the principles described herein. Example arrangements for an autogenous impact mill and related systems have been described herein with reference to particular components, features, properties, attributes, relationships and methods. However, it should be understood that in other embodiments other arrangements may include other components, features, properties, attributes, relationships and/or methods which provide similar capabilities and functionalities.

It will be readily understood that the features of exemplary embodiments as generally described and illustrated in the Figures can be arranged and designed in a wide array of different configurations. That is, features, structures and/or characteristics of embodiments or arrangements described herein may be combined in any suitable manner in one or more other embodiments or arrangements. Thus the detailed description of the exemplary embodiments of apparatus, methods and articles as represented in the Figures is not intended to limit the scope of the embodiments as claimed but is merely representative of selected exemplary embodiments that implement the principles as described herein.

In the foregoing description, certain terms have been used to describe example embodiments for brevity, clarity and understanding. However, certain terms such as "upward," "downward," "higher," "lower," "left," "right," "outer," "inner," "front," "rear," "top," and "bottom" have been used. However, no unnecessary limitations are to be implied therefrom because such terms have been used for descriptive purposes and are intended to be broadly construed, and such terms shall not be construed as limitations on the scope of the claims herein. Moreover the descriptions and illustrations herein are by way of examples and the inventive teachings are not limited to the specific details that have been shown and described.

The exemplary structures and arrangements along with the methods for configuring and using such structures and arrangements achieve desirable objectives, eliminate difficulties encountered in the use of prior devices and systems, solve problems and attain the desirable results described herein.

In the following claims any feature described as a means for performing a function shall be construed as encompassing any means known to those skilled in the art as being capable of performing the recited function, and shall not be deemed to be limited to the particular means used for performing the recited function and the foregoing description or mere equivalents thereof.

Having described the features, discoveries and principles of the exemplary embodiments, the manner in which they are constructed and operated, and the advantages and useful results obtained, the new and useful structures, devices, elements, arrangements, parts, combinations, systems, equipment, operations, methods, processes and relationships are set forth in the appended claims.

I claim:

1. An apparatus comprising:

an autogenous impact mill operative to size reduce material particles processed by the mill, including:

a housing, wherein the housing bounds an interior area, an air inlet, wherein the air inlet is in operative connection with the housing, wherein the air inlet enables air from outside the housing to enter the housing interior area, a rotatable shaft, wherein the shaft extends through the interior area and has a shaft diameter, a rotatable impeller, wherein the impeller is mounted in rotatable operatively supported connection with the shaft, wherein the rotatable impeller includes in operative connection therewith, a plurality of separate, angularly disposed radially extending arms, wherein each arm extends radially outward beyond the shaft a distance greater than the shaft diameter, and terminates radially outwardly in a respective outer peripheral impact head, at least one contoured fan blade surface, wherein the at least one contoured fan blade surface is operative to cause air movement within the interior area, wherein entry of air from outside the housing through the air inlet and impeller rotation in a rotational direction at a rotational velocity are operative to cause the plurality of arms and the at least one contoured fan blade surface to produce at least one air flow jet in the interior area, wherein the at least one air flow jet is directed in the rotational direction and is radially outward of the impact heads, wherein the at least one air flow jet is operative to hold material particles suspended radially outward of the impact heads adjacent to the at least one air flow jet via a Coanda Effect within the interior area by movement of air around respective convex surfaces of the suspended particles, wherein while such suspended material particles am held suspended, impeller rotation is operative to cause other material particles to be contacted by the impact heads and to move in the interior area responsive to such contact, wherein the suspended material particles in the interior area are impacted by the relatively moving contacted particles and the suspended material particles are broken into smaller particles responsive to such impacts.

2. The apparatus according to claim 1 wherein the housing interior area includes an exit opening, wherein the at least one jet is directed toward the exit opening, a plurality of ricochet bars within the interior area, wherein particles propelled by the at least one jet bounce off the ricochet bars and impact the suspended particles.

3. The apparatus according to claim 2 wherein each of the plurality of ricochet bars includes a generally planar ricochet surface, wherein particles bounce off the ricochet surface, wherein each ricochet surface is positioned at a different angle relative to other ricochet surfaces.

4. The apparatus according to claim 3 wherein the housing includes a removable concave lower pan portion, wherein the pan portion includes a concave surface that extends below the impeller.

5. The apparatus according to claim 4 wherein the at least one jet extends away from the concave surface.

6. The apparatus according to claim 1 wherein the air inlet comprises a valve controlled inlet, wherein the valve controlled inlet enables air from outside the housing to enter the housing interior area within an arc of rotation of the at least one contoured fan blade surface.

7. The apparatus according to claim 1 and further comprising:

a screen, wherein the screen includes a plurality of screen openings having a screen opening size, wherein the screen is positioned intermediate of the ricochet bars and the exit opening, wherein particles smaller than the screen opening size pass through the screen and the exit opening.

8. The apparatus according to claim 7 and further including at least one circuit, wherein the at least one circuit is in operative connection with the screen and is operative to cause an electrostatic charge that repels particles from the screen.

9. The apparatus according to claim 8, wherein the at least one circuit is in operative connection with at least one electrode operative to electrostatically repel particles away from a surface bounding the interior area of the housing.

10. The apparatus according to claim 9 wherein the housing includes an entrance opening, wherein the entrance opening is configured to accept material pieces in the interior area, and wherein the entrance opening extends above the impeller, a plurality of fracture plates within the interior area, wherein the plurality of fracture plates extend on an opposite side of the impeller from an opposed side including the plurality of ricochet bars.

11. The apparatus according to claim 10 and further comprising:

a guide plate within the interior area, wherein the guide plate extends below the entrance opening, wherein the guide plate is configured to slidably engage material pieces that have passed into the interior area through the entrance opening and to direct the pieces to the side of the interior area that includes the plurality of fracture plates.

12. The apparatus according to claim 11 wherein the guide plate terminates inwardly at an inward end, wherein the inward end is vertically above the impeller.

13. The apparatus according to claim 12 wherein each outer peripheral impact head is configured to engage material pieces that disengage the guide plate at the inward end and propel such pieces toward the fracture plates.

14. The apparatus according to claim 13 and further comprising:

a loading chute, wherein the loading chute is configured to hold material pieces and guide such pieces toward the entrance opening.

15. The apparatus according to claim 14 and further comprising:

a selectively, rotatably movable valve plate, wherein the valve plate is movable between a closed position wherein the plate prevents pieces from passing from the loading chute into the interior area, and an open position in which the valve plate opens the entrance opening and is disposed further away from the guide plate than in the closed position.

16. The apparatus according to claim 15 and further comprising:

a delivery chute, wherein the delivery chute extends away from the exit opening, wherein material particles smaller than the screen opening size are directed away from the housing interior area by the delivery chute.

17. The apparatus according to claim 16 wherein the delivery chute includes a generally downward facing outlet opening, wherein material particles exit from the delivery chute through the outlet opening.

18. The apparatus according to claim 17 and further including:

a positive pressure port in operative connection with the housing, wherein the positive pressure port is operative to direct air into the interior area and along a convex surface of the guide plate.

19. The apparatus according to claim 18 and further comprising:

a negative pressure port in operative connection with the interior area of the housing, wherein the negative pressure port is operative to draw air out of the interior area and on the side including the ricochet bars.

20. An apparatus comprising:

an autogenous impact mill operative to size reduce material particles processed by the mill, including:

a housing, wherein the housing bounds an interior area, and includes a concave surface, a plurality of ricochet bars, and an exit opening, wherein each of the plurality of ricochet bars includes a ricochet surface that has a different angle relative to other ricochet surfaces, at least one rotatable fan blade, wherein the at least one fan blade causes air movement within the interior area of the housing, a manifold, wherein the manifold includes a valve controlled inlet, wherein the inlet enables air from outside the housing to enter the housing interior area adjacent the at least one fan blade, a rotatable shaft, wherein the shaft extends through the interior area and has a shaft diameter, a rotatable impeller, wherein the impeller is mounted in rotatable operatively supported connection with the shaft above the concave surface, wherein the impeller includes a plurality of separate, angularly disposed radially extending arms, wherein each arm extends radially outward beyond the shaft a distance greater than the shaft diameter, wherein each arm terminates radially outwardly in a respective outer peripheral impact head, wherein impeller and fan blade rotation are operative to cause air flow including at least one air flow jet in the interior area, wherein the at least one air flow jet extends away from the concave surface and toward the exit opening of the interior area, is operative to hold at least some material particles suspended within the interior area by movement of air around respective convex surfaces of the suspended particles adjacent to the at least one jet via a Coanda Effect, and propel other material particles to impact and bounce off the ricochet bars, wherein while such suspended material particles are held suspended, impeller rotation is operative to cause further material particles to be contacted by the impact heads and to move in the interior area responsive to such contact, wherein the suspended material particles in the interior area are impacted by the relatively moving other material particles and further material particles, and wherein the suspended material particles are broken into smaller particles responsive to such impacts.

21. The apparatus according to claim 20 and further including a circuit, wherein the circuit is in operative connection with at least one electrode operative to electrostatically repel particles away from a surface bounding the interior area of the housing.

22. The apparatus according to claim 20 and further including an entrance opening, wherein the entrance opening is configured to accept material pieces in the interior area, and wherein the entrance opening extends above the rotatable impeller, wherein the plurality of ricochet bars extend on a first side of the rotatable impeller in the interior area, a plurality of fracture plates within the interior area, wherein the plurality of fracture plates extend on a second side of the rotatable impeller, wherein the second side of the interior area is opposed of the first side of the interior area.

23. The apparatus according to claim 20 a screen, wherein the screen includes a plurality of screen openings having a screen opening size, wherein the screen is positioned intermediate of the ricochet bars and the exit opening, wherein the particles smaller than the screen opening size pass through the screen openings and the exit opening.

24. The apparatus according to claim 20 wherein the distance each arm extends corresponds to at least three shaft diameters.

25. The apparatus according to claim 20 wherein the impeller further includes at least one support brace, wherein each support brace extends angularly intermediate of and in fixed operative engagement with each arm of each respective immediately angularly adjacent pair of arms, wherein each support brace is disposed entirely radially inwardly of the outer peripheral impact heads.

26. The apparatus according to claim 20 wherein the impeller is rotatable about an axis in a rotational direction, wherein each arm includes a continuous planar face surface, wherein each respective face surface faces the rotational direction and extends continuously both in the axial direction and radially outward from an outer surface of the shaft to the respective impact head.

27. An apparatus comprising:

an autogenous impact mill operative to size reduce material particles processed by the mill, including:

a housing, wherein the housing bounds an interior area and includes a concave lower bottom surface that bounds the interior area, a loading chute, an entrance opening to the interior area, a selectively rotatably movable valve plate, wherein the loading chute is configured to hold material pieces and guide such pieces toward the entrance opening, wherein the entrance opening is configured to accept material pieces into the interior area at an upper area thereof, wherein the valve plate is selectively movable between a closed position in which the valve plate prevents material pieces from passing from the loading chute into the interior area, and an open position in which at least a portion of the valve plate is disposed away from the entrance opening to enable material pieces to pass from the loading chute through the entrance opening, a guide plate, wherein the guide plate is positioned in the interior area and below the entrance opening, wherein the guide plate is configured to engage material pieces that enter the interior area through the entrance opening and to direct such pieces to a first lateral side of the interior area, at least one rotatable fan blade, wherein the at least one fan blade extends in the interior area and is operative to cause air movement within the interior area of the housing, a manifold, wherein the manifold includes a valve controlled inlet, wherein the manifold enables air from outside the housing to enter the interior area of the housing within an arc of rotation of the at least one fan blade, at least one rotatable impeller, wherein the at least one impeller extends above the lower concave surface, includes at least one radially outer peripheral head, wherein the at least one head is configured to engage and propel material pieces that have passed into the first side of the interior area, a plurality of fracture plates, wherein the plurality of fracture plates extend on the first side of the interior area, wherein material pieces that engage the at least one head on the first side of the interior area are propelled toward the fracture plates, wherein rotation of the at least one rotatable impeller is operative to cause at least one air flow jet in the interior area, wherein the at least one air flow jet extends away from the concave bottom surface of the housing, wherein the at least one air flow jet is operative to cause particles of material to be held suspended adjacent to the at least one air flow jet in the interior area by movement of air around respective convex surfaces of the material particles via a Coanda Effect, a plurality of ricochet bars, wherein the plurality of ricochet bars extend on a second lateral side of the interior area opposed of the first lateral side, wherein the at least one impeller extends between the first lateral side and the second lateral side, wherein at least some material particles engaged by the at least one peripheral head in the second lateral side are propelled by the at least one peripheral head to engage the ricochet bars, wherein the ricochet bars are configured such that material particles engage and bounce off the ricochet bars and impact the particles that are held suspended via the Coanda Effect, an exit opening from the housing, wherein the exit opening extends on the second lateral side and wherein the at least one jet is directed toward the exit opening, a screen, wherein the screen includes a plurality of screen openings each having a screen opening size, is positioned intermediate of the ricochet bars and the exit opening, and wherein material particles that are smaller than the screen opening size are enabled to pass through the screen and the exit opening, at least one circuit, wherein the at least one circuit is in operative connection with the screen and at least one electrode, wherein the at least one circuit is operative to cause electrostatic charge that is operative to repel particles from the screen and from a surface bounding the interior area of the housing associated with the at least one electrode.

* * * * *